US010407911B2

(12) United States Patent
Fenske

(10) Patent No.: US 10,407,911 B2
(45) **Date of Patent: *Sep. 10, 2019**

(54) MULTI-PURPOSE ANCHOR DEVICES

(71) Applicant: Eric Fenske, Chicago, IL (US)

(72) Inventor: Eric Fenske, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/037,162

(22) Filed: Jul. 17, 2018

(65) Prior Publication Data

US 2018/0320378 A1 Nov. 8, 2018

Related U.S. Application Data

(63) Continuation of application No. 14/732,023, filed on Jun. 5, 2015, now Pat. No. 10,053,863.

(51) Int. Cl.

| | |
|---|---|
| ***E04C 5/12*** | (2006.01) |
| ***E04B 1/41*** | (2006.01) |
| ***E04B 2/88*** | (2006.01) |

(52) U.S. Cl.

CPC ..... *E04C 5/12* (2013.01); *E04B 1/41* (2013.01); *E04B 1/4107* (2013.01); *E04B 2/88* (2013.01)

(58) Field of Classification Search

CPC ..... E04B 1/41; E04B 1/4107; E04B 1/4114; E04B 1/4135; E04B 2/88; E04C 5/12; E04G 21/12

USPC ..... 52/223.13, 698, 702, 704–708, 710

See application file for complete search history.

(56) References Cited

U.S. PATENT DOCUMENTS

| | | | | | |
|---|---|---|---|---|---|
| 1,155,243 | A * | 9/1915 | Jordahl | E04B 1/4107 | 248/343 |
| 3,263,384 | A * | 8/1966 | Middendorf | E04C 5/125 | 24/122.6 |
| 3,621,626 | A * | 11/1971 | Tylius | E04B 1/043 | 403/363 |
| 3,952,468 | A * | 4/1976 | Soum | E04B 1/22 | 52/223.13 |
| 4,073,114 | A * | 2/1978 | Irish | E04B 1/4107 | 52/223.13 |
| 4,574,545 | A * | 3/1986 | Reigstad | E04G 23/0218 | 264/228 |
| 4,604,003 | A * | 8/1986 | Francoeur | E02D 5/523 | 29/452 |
| 7,234,566 | B2 * | 6/2007 | Simmons | B66B 7/027 | 104/124 |
| 10,053,863 | B2 * | 8/2018 | Fenske | E04C 5/12 | |
| 2009/0056250 | A1 * | 3/2009 | Bransford | B25B 13/08 | 52/223.13 |
| 2011/0314764 | A1 * | 12/2011 | Basche | B28B 23/0056 | 52/698 |
| 2013/0248671 | A1 * | 9/2013 | Schleiermacher | E04B 1/41 | 248/309.1 |
| 2014/0250825 | A1 * | 9/2014 | Richardson | E04B 1/4107 | 52/710 |

(Continued)

*Primary Examiner* — Theodore V Adamos
(74) *Attorney, Agent, or Firm* — Seyfarth Shaw LLP

(57) ABSTRACT

A multi-purpose anchor device for use in anchoring one or more tension cables and one or more window or curtain walls. In this respect, the anchor includes a channel, angle bracket, or plate for use in attaching to a window or curtain wall. One or more tension cables are also coupled to the anchor, which anchors the tension cables. The multi-purpose nature of the anchor allows for the reduction in materials cost, installation time, and conflict issues between placement of previously known anchors.

8 Claims, 13 Drawing Sheets

(56) References Cited

U.S. PATENT DOCUMENTS

2014/0318074 A1* 10/2014 Heudorfer ..... E04B 1/4107
52/710

* cited by examiner

MULTI-PURPOSE ANCHOR DEVICES

CROSS REFERENCE TO RELATED APPLICATIONS

The present application is a continuation of and claims priority to U.S. patent application Ser. No. 14/732,023, filed on Jun. 5, 2015, entitled Multi-Purpose Anchor Devices, the contents of which are incorporated by reference herein in their entirety.

TECHNICAL FIELD

The present invention relates generally to an anchor device. More particularly, the present invention relates to an anchor device for post tensioned cables and window or curtain walls.

BACKGROUND

Post-tensioned type concrete structures are common in the building construction industry. Such post-tensioned concrete structures are commonly used, for example, as floor decks. Post-tensioned concrete structures allow for thinner concrete structures and/or greater column free spaces. In general, reinforcing steel strands are positioned in the concrete formwork at predetermined locations prior to the concrete being poured. Traditionally, the strands are positioned to be within a thickness of the concrete structure, with a high point at a support or near an edge of the concrete formwork and a low point at a middle area of the concrete formwork. After the concrete is poured and hardened, each strand is tensioned, for example, at a load of about 26,000 pounds. The tensioned strands add a pre-tensioned force to the concrete structure. At the vertical edge of concrete structure, steel plate anchors are used at each strand or group of strands to spread out the large tensile forces over a larger area of concrete than each strand itself.

Window wall anchors or curtain wall anchors may also be embedded in the concrete structure and used to support an exterior wall or skin of a building. In general, the wall anchors are installed in the concrete formwork at predetermined locations (i.e., at the vertical edges of the concrete structure) prior to the concrete being poured. The wall anchor typically includes headed steel studs that are welded to the wall anchor, which serve to fasten the wall anchor to the hardened concrete structure. Some wall anchors are formed of a steel 'C' channel or a steel plate that is folded creating a trench within it. The interior of the 'C' channel or the trench serves to support pins that are connected to wall panels. These pins fit into the 'C' channel or trench and are then turned to lock the pin to the wall anchor. Other wall anchors provide a plate onto which a wall is attached using fasteners and/or welding.

However, there are times when a plate anchor for a tensioned steel strand and a wall anchor need to be positioned at a same location on the edge of the concrete structure. Thus, a trade-off may have to be made whether to include the wall anchor or the plate anchor. This can limit the position of the tensioned steel strands and/or walls of the structure or building being constructed.

SUMMARY

The present invention broadly includes a multi-purpose anchor device for use in anchoring one or more tension cables and one or more window or curtain walls. In this respect, the anchor includes a channel, angle or plate that receives an anchor pin, fastener, etc. for use in attaching to a window or curtain wall. One or more tension cables are also coupled to the anchor, which anchors the tension cables. The multi-purpose nature of the anchor allows for the reduction in materials cost, as opposed to previously known anchors, by combining the functions of one or more previously known anchors into a single anchor device.

The multi-purpose anchor device also reduces the amount of anchors needed in certain applications. For example, the multi-purpose anchor device serves multiple functions, thereby eliminating the need for multiple anchors and reducing installation time. The multi-purpose anchor device also resolves issues of conflicts between the placement of previously known anchors. For example, the multi-purpose anchor device may be used in place of using two separate anchors (a plate anchor for a tension cable and a wall anchor) that need to be positioned at a same location on an edge of a concrete structure. This saves on coordination time prior to installation and/or costly fixes if the issue is found after or during installation of the anchors.

In an embodiment, the anchor device includes a base portion that is adapted to couple a wall to an edge of a concrete structure. The base portion includes a first side, and a tension cable is coupled to the first side and extends from the first side into the concrete structure. In one embodiment, the base portion may include the first side, a second side extending from the first side in a first direction, and a third side extending from the first side in the first direction. These sides form a channel (such as a 'C' type channel). In another embodiment, the base portion may include the first side a second side adapted to face away from the edge of the concrete structure and couple the wall to the edge of the concrete structure. In yet another embodiment, the base portion may include a first portion and a second portion extending from and substantially perpendicular to the first portion. In this embodiment, the first portion includes the first side and is adapted to extend along a vertical edge of the concrete structure, and the second portion is adapted to extend along a horizontal edge of the concrete structure and couple the wall to the concrete structure.

In an embodiment, an anchor device for concrete includes a base portion having a first side and is adapted to couple a wall to an edge of a concrete structure. An aperture is in the first side that is adapted to receive a tension cable. In one embodiment, the base portion may include the first side, a second side extending from the first side in a first direction, and a third side extending from the first side in the first direction. These sides form a channel (such as a 'C' type channel). In another embodiment, the base portion may include the first side a second side adapted to face away from the edge of the concrete structure and couple the wall to the edge of the concrete structure. In yet another embodiment, the base portion may include a first portion and a second portion extending from and substantially perpendicular to the first portion. In this embodiment, the first portion includes the first side and is adapted to extend along a vertical edge of the concrete structure, and the second portion is adapted to extend along a horizontal edge of the concrete structure and couple the wall to the concrete structure.

In an embodiment, an anchor system for concrete includes first and second anchor devices adapted to be disposed along a first and second opposing edges of a concrete structure and couple a wall to the concrete structure. The first anchor device may include a first base portion having a first side adapted to face in a direction towards the concrete structure, and a tension cable coupled to the first side and adapted to extend from the first side into the concrete structure. The second anchor device may include a second base portion having a first side adapted to face in a direction towards the concrete structure, and an aperture in the first side adapted to receive the tension cable.

In yet another embodiment, a method of constructing a post-tensioned concrete structure includes disposing a first anchor device at a first edge of a concrete formwork for the concrete structure, and a second anchor device at a second edge of the concrete formwork opposite the first edge. The first anchor device may include a first base portion adapted to couple a wall to the concrete structure and a tension cable coupled to the first base portion and extending from the first base portion into the concrete formwork. The second anchor device may include a second base portion adapted to couple a wall to the concrete structure and an aperture adapted to receive the tension cable. The tension cable is extended across the concrete formwork and through the aperture of the second anchor device. The concrete is poured into the concrete formwork, and the tension cable is tensioned after the concrete has hardened.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION

Figure 1:
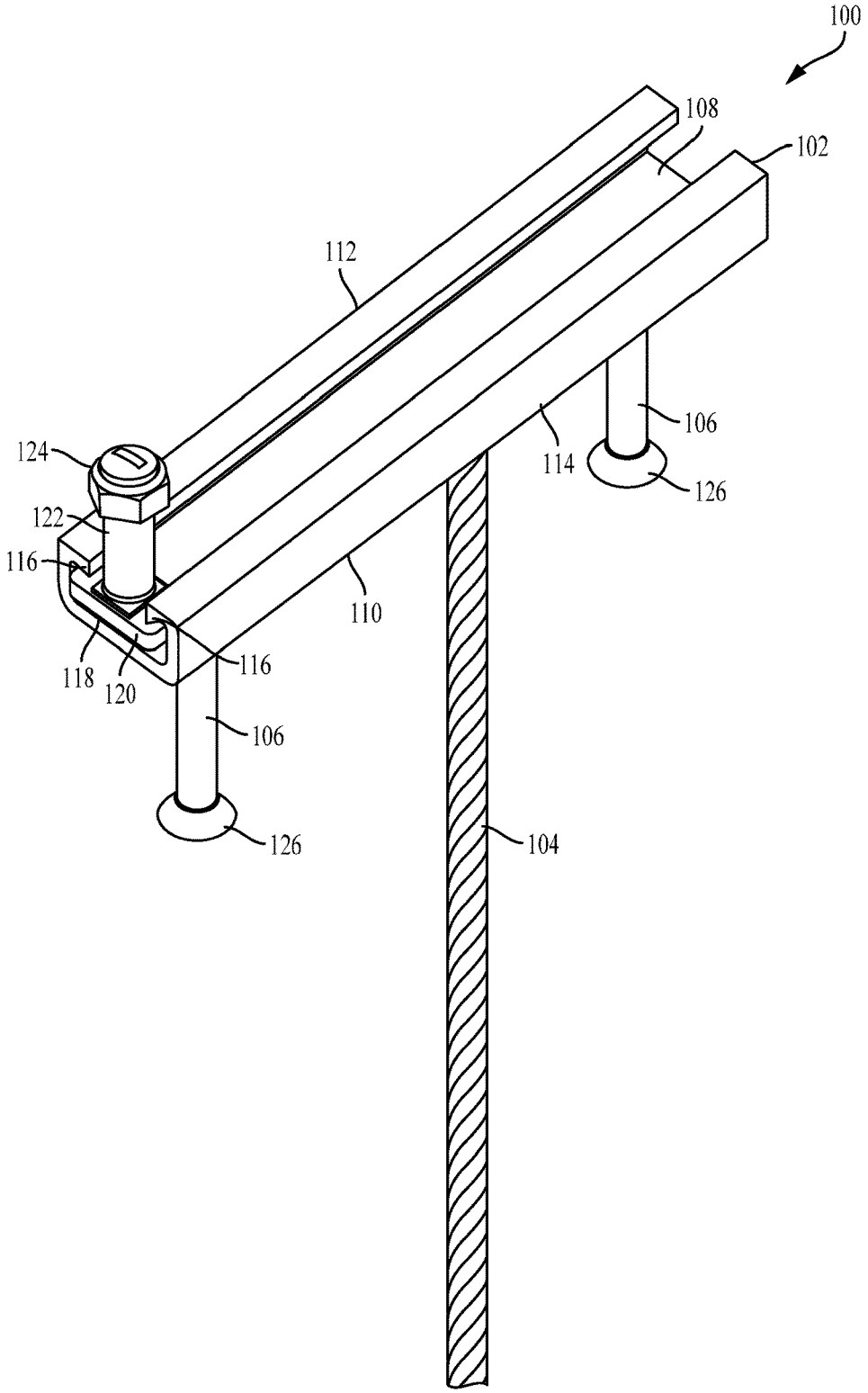
FIG. 1 is a first perspective view of an anchor device according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly includes a multi-purpose anchor device for use in anchoring one or more tension cables and one or more window or curtain walls. In this respect, the anchor includes a channel, angle or plate that receives an anchor pin, fastener, etc. for use in attaching to a window or curtain wall. One or more tension cables are also coupled to the anchor, which anchors the tension cables. The multi-purpose nature of the anchor allows for the reduction in materials cost, as opposed to previously known anchors, by combining the functions of one or more previously known anchors into a single anchor device.

The multi-purpose anchor device also reduces the amount of anchors needed in certain applications. For example, the multi-purpose anchor device serves multiple functions, thereby eliminating the need for multiple anchors and reducing installation time. The multi-purpose anchor device also resolves issues of conflicts between the placement of previously known anchors. For example, the multi-purpose anchor device may be used in place of using two separate anchors (a plate anchor for a tension cable and a wall anchor) that need to be positioned at a same location on an edge of a concrete structure. This saves on coordination time prior to installation and/or costly fixes if the issue is found after or during installation of the separate anchors.

Figure 2:
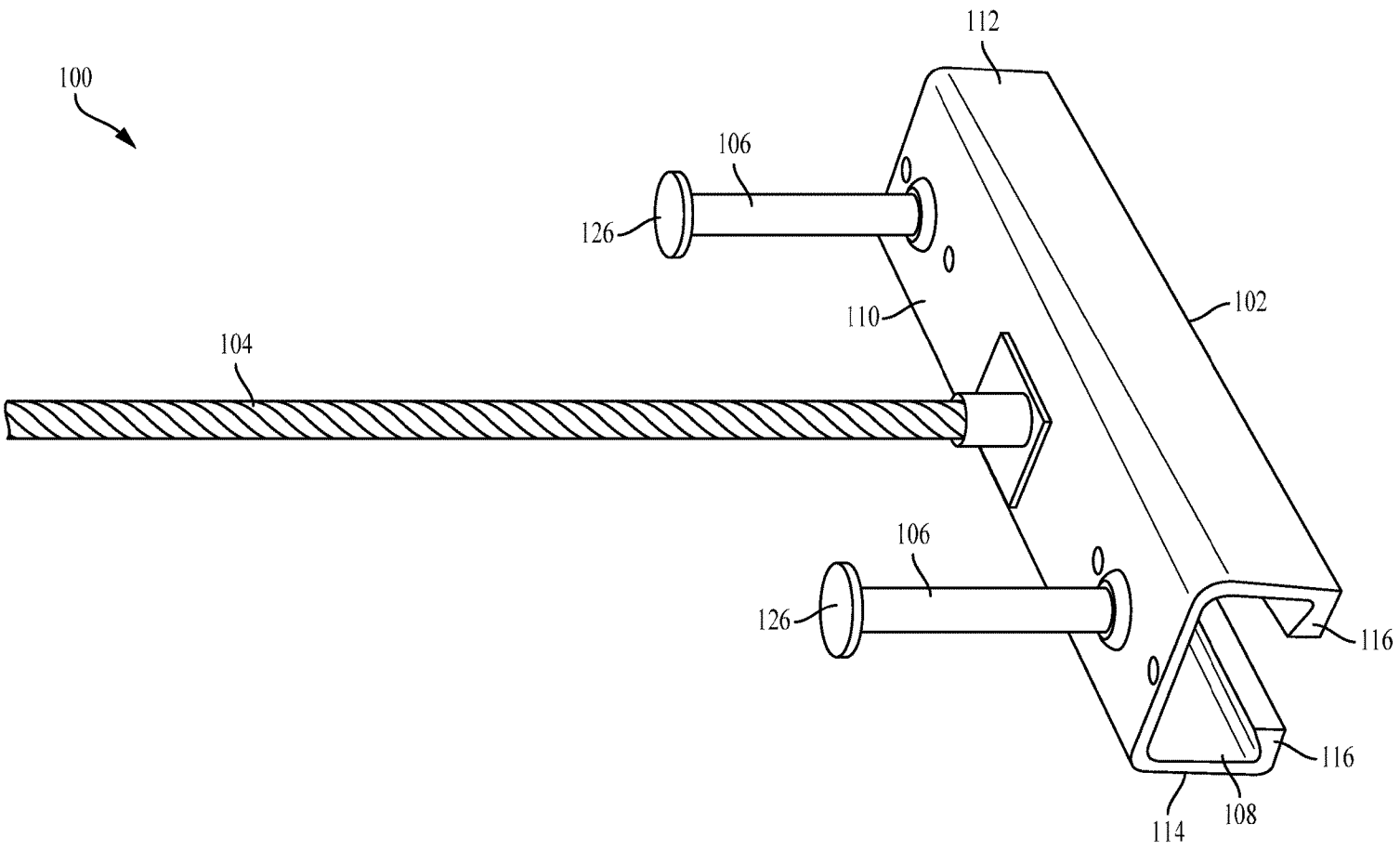
FIG. 2 is a second perspective view of the anchor device of FIG. 1 according to an embodiment of the present invention.

Referring to FIGS. 1 and 2, in an embodiment, an anchor 100 includes a base portion 102, one or more tension cables 104 coupled to the base portion 102, and one or more anchor studs 106 coupled to the base portion 102. The base portion 102 forms a 'C' type channel 108 having a first side 110, a second side 112 extending from the first side 110 in a substantially perpendicular direction, and a third side 114 opposite the second side 112 and extending from the first side 110 in the substantially perpendicular direction. The base portion 102 may also include teeth 116 respectively extending from edges of the second side 112 and third side 114 opposite the first side 110. The teeth 116 may also extend in a direction into the channel 108 (i.e., towards the first side 110).

One or more anchor pins 118 may be disposed in the 'C' type channel 108. The anchor pin(s) 118 may include a head 120, a threaded portion 122 extending from the head 120, and a fastener or nut 124 that may be threaded onto the threaded portion 122. In this respect, the head 120 of the anchor pin(s) 118 may be disposed in the channel 108, turned, and engaged with teeth 116 of the channel 108. The anchor pin(s) 118 may be used to couple a window wall or curtain wall to the anchor 100 when the anchor 100 is installed in a concrete structure, floor, wall, or other structure of the type. The anchor pin(s) 118 may also be used to couple a mounting bracket or other type of connector or mounting means to the anchor 100 for use in coupling a window wall or curtain wall to the anchor 100 when the anchor 100 is installed.

The tension cable(s) 104 may be coupled to the base portion 102 on the first side 110 and extend from the first side 110 in a substantially perpendicular direction opposite the direction of the second side 112 and third side 114 (or opposite the opening of the channel 108). The tension cable(s) 104 may be coupled to the base portion 102 via welding, bracket, and/or fasteners. The tension cable(s) 104 may be a rod or cable having wire strands, laid or twisted helically around a core; and/or having a wire rope, structural strand, or full locked cable construction. The tension cable(s) may be steel, such as stainless steel, galvanized steel, or other type of suitable material.

The anchor studs 106 may be coupled to the base portion 102 on the first side 110 and extend from the first side 110 in a substantially perpendicular direction opposite the direction of the second side 112 and third side 114 (or opposite the opening of the channel 108). The anchor studs 106 may also terminate on an opposite end in a head portion 126. The anchor studs 106 may be coupled to the base portion 102 via welding and/or fasteners. The anchor studs 106 may also be steel, such as stainless steel, galvanized steel, or other type of suitable material.

The anchor 100 may be positioned in a concrete formwork, for example, of a floor structure, at predetermined locations prior to concrete being poured. In one example, the anchor 100 may be positioned at a vertical edge of the concrete structure that is to be poured with the channel 108 facing away from the concrete structure, and the tension cable(s) 104 and the anchor stud(s) 106 extending into the concrete structure. When the concrete is poured and substantially cured, the anchor stud(s) 106 serve to anchor the body portion 102 to the concrete structure. Additionally, when the concrete is poured and substantially cured, the tension cable(s) 104 may be tensioned, thereby compressing or pulling the anchor 100 inwardly to the edge of the concrete structure.

Figure 3:
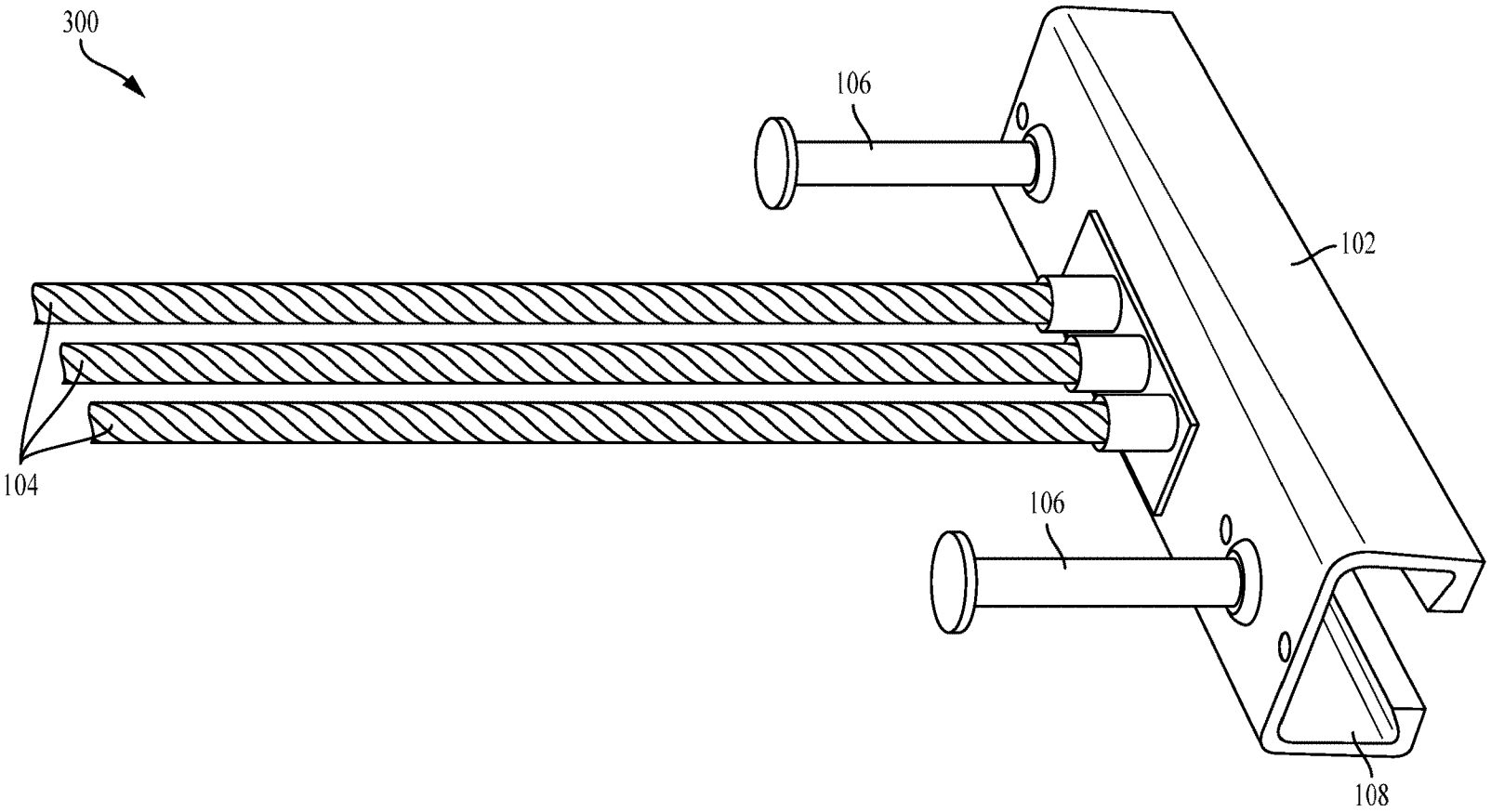
FIGS. 3-5 are perspective views of other anchor devices according to embodiments of the present invention.

As illustrated in FIGS. 1 and 2, the anchor 100 includes one tension cable 104 positioned between the anchor studs 106. However, the anchor 100 may include more than one tension cable 104 or any number of tension cables 104. For example, as illustrated in FIG. 3, an anchor 300, having base portion 102, may include a group of tension cables 104 positioned between the anchor studs 106.

In another embodiment, the anchor studs 106 may be removed or replaced by one or more tension cable(s) 104. This is possible because, as mentioned above, when the tension cable(s) 104 are tensioned, the tension cable(s) 104 exert a force on the anchor compressing the anchor to the edge of the concrete structure.

Figure 4:
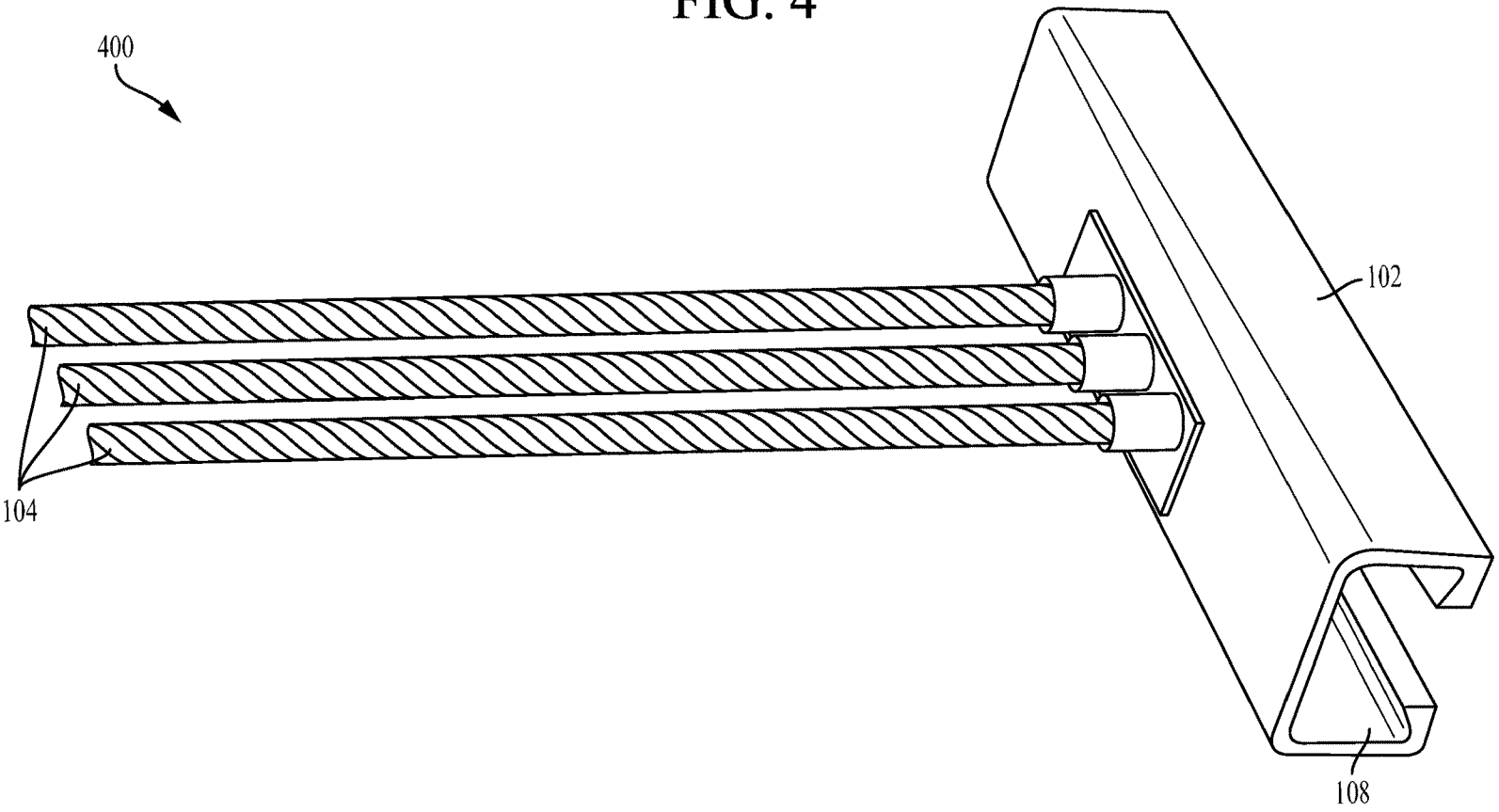
Figure 5:
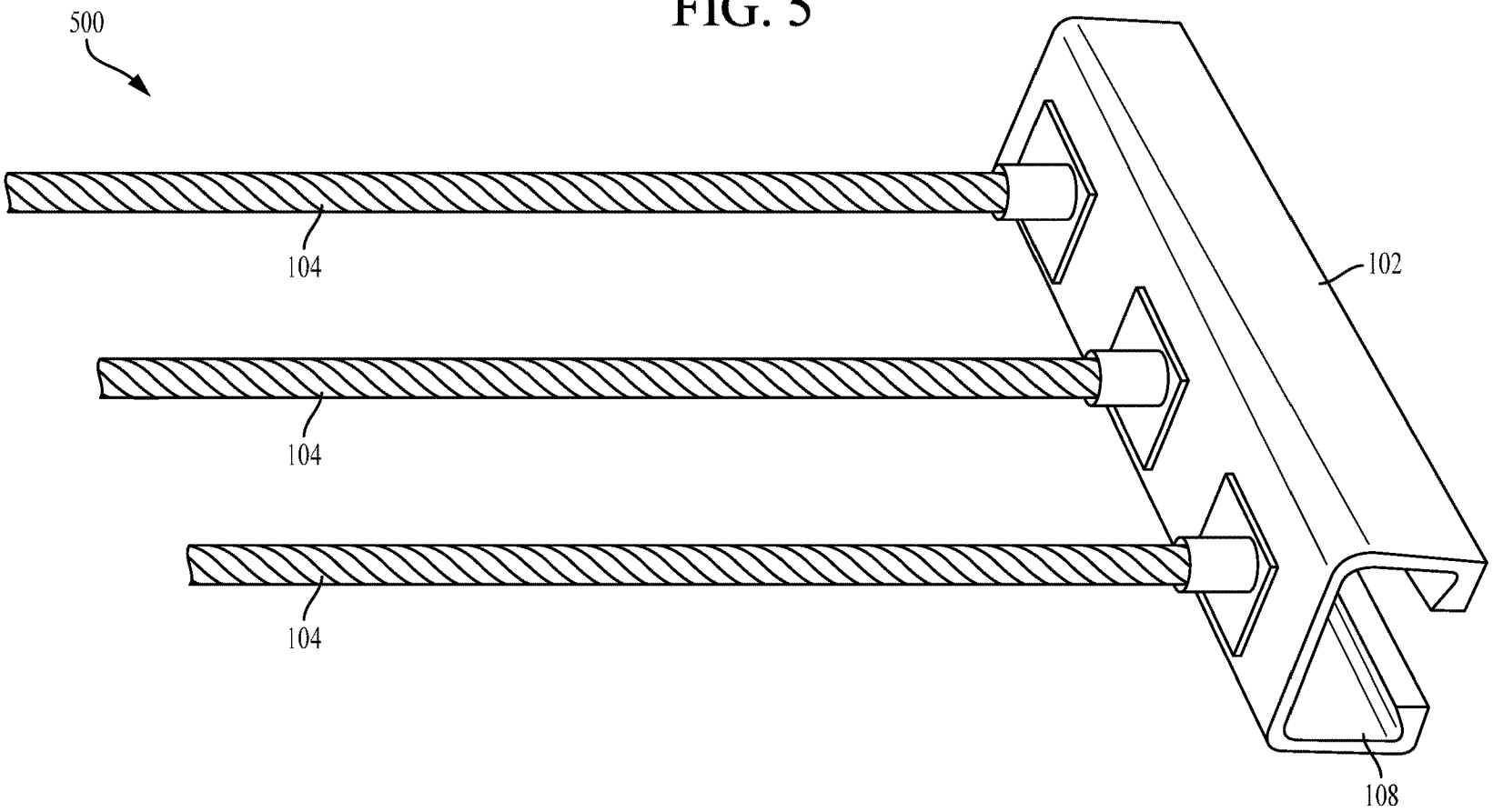

Referring to FIGS. 4 and 5, in another embodiment, anchors 400 and 500 may respectively include base portion 102 and one or more tension cables 104 extending from the base portion 102, as described above. As illustrated in FIG. 4, the anchor 400 includes a group of tension cables 104 positioned near a center of the base portion 102. As illustrated in FIG. 5, the anchor 500 includes three tension cables 104 spaced along a length of the base portion 102. It should be appreciated that any number of tension cable(s) 104 and/or anchor studs 106 may be used.

Figure 6:
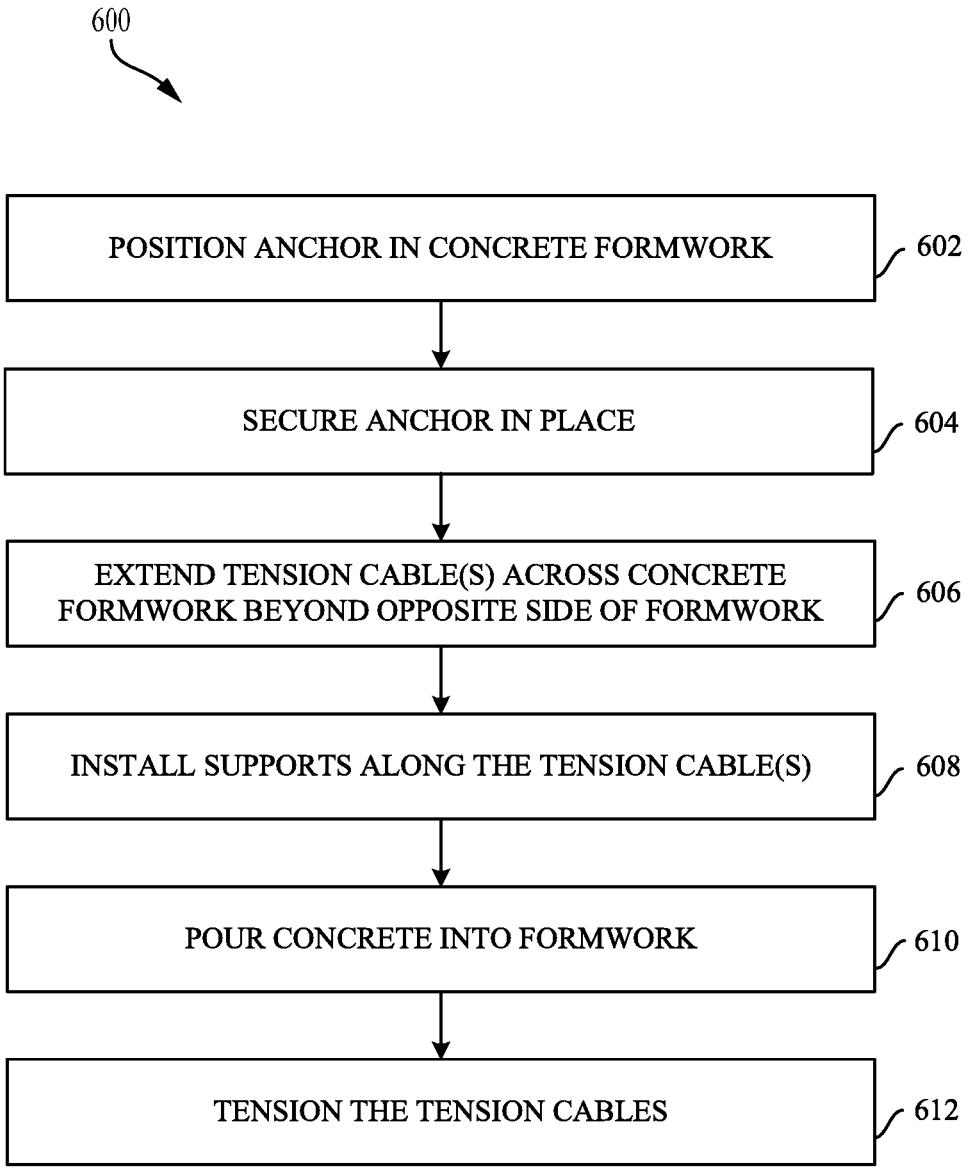
FIG. 6 is a flow chart illustrating a process of installing an anchor device according to an embodiment of the present invention.

A method 600 for installing an anchor 100, 300, 400, and/or 500 is described with reference to FIG. 6. As illustrated in block 602, anchors 100, 300, 400, and/or 500 are positioned in a concrete formwork, for example, of a floor structure, at predetermined locations prior to concrete being poured. The anchors may be preassembled, coiled up and brought to the site. The anchors may be positioned at a vertical edge of the concrete formwork with the channel of the anchor facing away from the area where concrete is to be poured (and the anchor stud(s) if applicable extending into the area where the concrete is to be poured). The anchor is secured in place, illustrated as block 604, and the tension cable(s) are extended across the concrete formwork and beyond an opposing side of the concrete formwork, illustrated as block 606. Supports or chairs may also be installed along the tension cable(s) to lift the tension cable(s), illustrated as block 608. The supports may be installed to cause the tension cable(s) to be positioned in substantially a middle of a thickness of the concrete structure to be formed. The supports may be installed prior to or after positioning of the anchors and tension cables.

The concrete is then poured into the formwork, illustrated as block 610. When the concrete is substantially cured, the tension cable(s) are tensioned from the end of the tension cable that extends beyond the opposite side of the concrete structure, illustrated as block 612, thereby compressing or pulling the anchor to the edge of the concrete structure. A separate plate anchor or other anchor may be used to anchor the end of tensioned cable on the opposite side.

Figure 7:
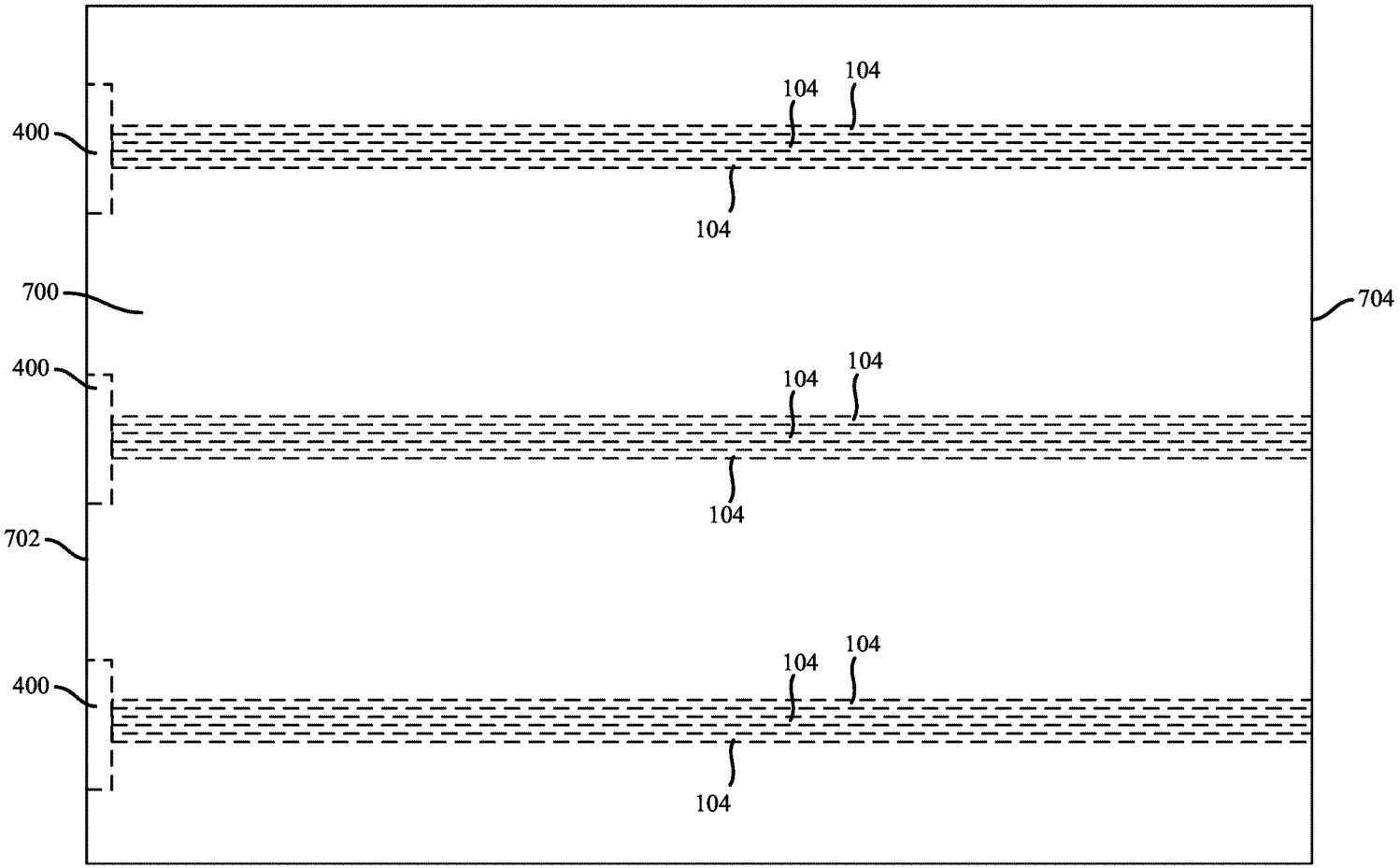
FIG. 7 is a top view of an anchor device installed according to an embodiment of the present invention.

Any one or more of anchors 100, 300, 400, and/or 500 may have a length or plurality of sections (similar to that illustrated in FIGS. 1-5) allowing the anchor to extend across a desired portion of a vertical edge of a concrete structure. Further, a plurality of anchors may be used in construction of the concrete structure. For example, referring to FIG. 7, an example of a plurality of anchors 400 installed in a concrete structure 700 is illustrated. The anchors 400 are located on a first vertical edge 702 of the concrete structure 700 and extend across a desired length of the first vertical edge 702. A plurality of tension cable groups, each including the tension cables 104 extend from the anchors 400 across the concrete structure 700 to a second vertical edge 704 of the concrete structure 700. In this example, the tension cables 104 are tensioned from the second vertical edge 704, and may then be anchored to the concrete structure 700.

In general, the anchors 100 and 300-500 described above are installed in a concrete formwork, for example, of a floor structure, at predetermined locations prior to concrete being poured. In this respect, the tension cable(s) 104 are not accessible from the edge of the concrete structure where the anchor 100 and 300, 400, or 500 is positioned, and are tensioned from an edge opposite the anchor 100 and 300, 400, or 500. In other embodiments, anchor devices are disclosed that are similar to the anchors 100 and 300-500, but include one or more apertures through which a tension cable extends to allow for the tension cable to be tensioned. The tensioned cable may then be fastened to the anchor using one or more fasteners. In one example, the fastener may include a head similar to that of the anchor pin 118, described above, that engages teeth 116.

Referring to FIGS. 8A-10, anchors 800, 900, and 1000 each includes base portion 102 having the first side 110. Instead of tensions cable(s) 104 being coupled to the first side 110 of the base portion 102, the first side 110 includes one or more apertures. For example, anchor 800 includes an aperture 802, anchor 900 includes apertures 902, and anchor 1000 includes apertures 1002. In these examples, the anchor 800 may be a corresponding anchor to that of anchor 100, the anchor 900 may be a corresponding anchor to that of anchors 300 and 400, and the anchor 1000 may be a corresponding anchor to that of anchor 500.

Figure 8A:
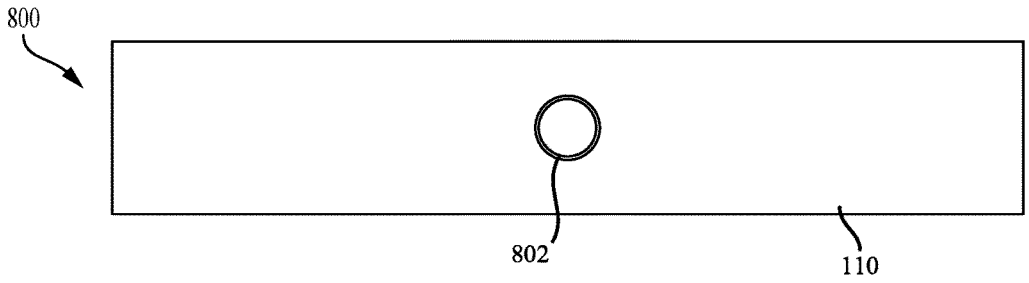
FIGS. 8A-10 are perspective views of still other anchor devices according to embodiments of the present invention.
Figure 8B:
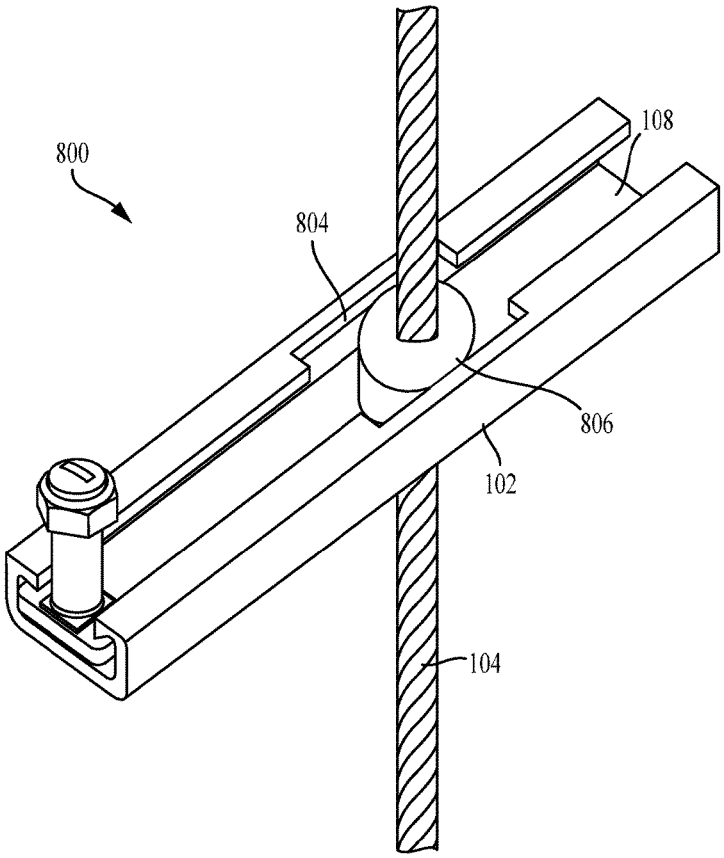
Figure 9:
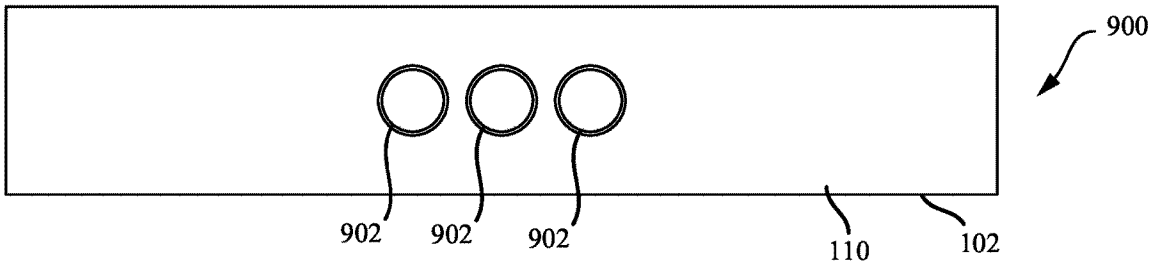
Figure 10:
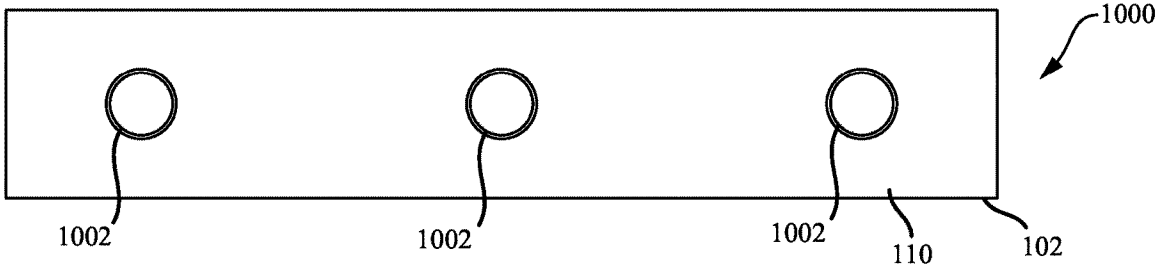

The anchors 800, 900, and 1000 may also include a cut-out 804 (illustrated in FIG. 8B). The cut-out may be included to allow access into the channel 108 for a tensioning tool and/or a fastening device 806, such as a cable anchor or nut, or cable bracket to be used to tension and anchor the tension cable(s) 104. In some embodiments, the anchors 800-1000, respectively, may also include one or more anchor studs 106.

An anchor 800, 900, or 1000 may be positioned at a first vertical edge of a concrete formwork, for example, of a floor structure, prior to concrete being poured with the channel 108 facing away from the concrete structure. Similarly, a corresponding anchor 100, 300, 400 or 500 may be positioned at a second vertical edge of a concrete formwork, opposite to and aligned with the anchor 800, 900, or 1000, prior to concrete being poured with the channel 108 facing away from the concrete structure. The tension cable(s) 104 extending from the anchor 100, 300, 400 or 500 may be extended across the concrete formwork and through the corresponding aperture(s) of the anchor 800, 900, or 1000. When the concrete is poured and substantially cured, the tension cable(s) 104 may be tensioned, thereby compressing or pulling the corresponding anchor pair to the edges of the concrete structure. The tensioned cable may be fastened to the anchor 800, 900, or 1000 using one or more fastening devices, such as fastening devices 806 or 906. In one example, the fastening device may include a head similar to that of the anchor pin 118, described above, that engages teeth 116.

Figure 11:
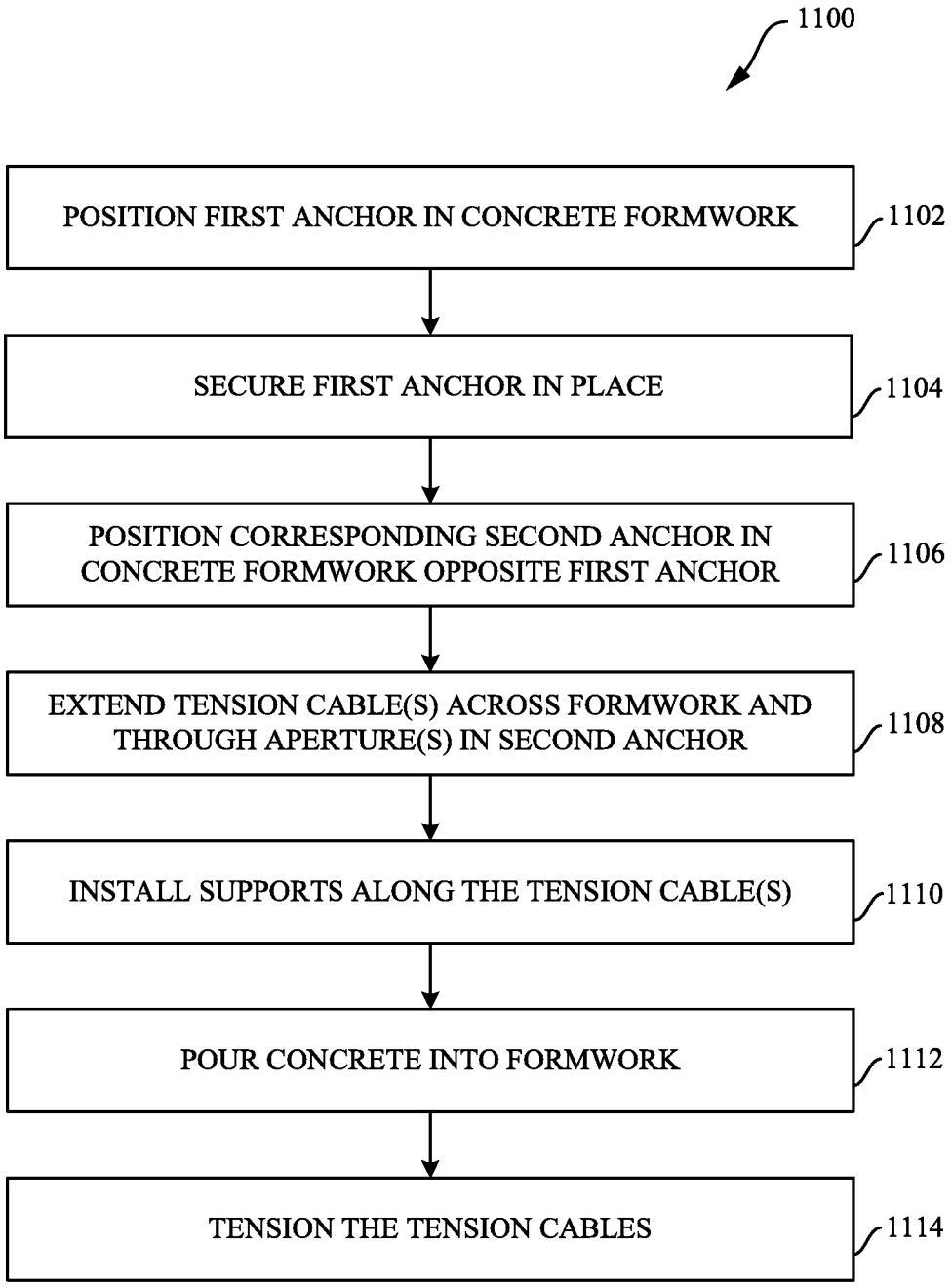
FIG. 11 is a flow chart illustrating a process of installing more than one anchor device according to an embodiment of the present invention.

A method 1100 for installing an anchor 100, 300, 400, or 500 and a corresponding anchor 800, 900, or 1000 is described with reference to FIG. 11. As illustrated in block 1102, an anchor 100, 300, 400, and/or 500 is positioned in a concrete formwork, for example, of a floor structure, at a predetermined location prior to the concrete being poured. The anchors may be preassembled, coiled up and brought to the site. The anchor may be positioned at a first vertical edge of the concrete formwork with the channel of the anchor facing away from the area where concrete is to be poured (and the anchor stud(s), if applicable, extending into the area where the concrete is to be poured). The anchor is then secured in place, illustrated as block 1104. A corresponding anchor 800, 900, or 1000 is positioned in the concrete formwork at a location opposite to and aligned with the anchor 100, 300, 400, and/or 500 prior to concrete being poured, illustrated as block 1106. The anchor 800, 900, or 1000 may be positioned at a second vertical edge of the concrete formwork with the channel of the anchor facing away from the area where concrete is to be poured (and the anchor stud(s) if applicable extending into the area where the concrete is to be poured). The tension cable(s) of the anchor 100, 300, 400, and/or 500 are extended across the concrete formwork and through the corresponding apertures of the anchor 800, 900, or 1000, illustrated as block 1108. Supports or chairs may also be installed along the tension cable(s) to lift the tension cable(s), illustrated as block 1110. The support may be installed to cause the tension cable(s) to be positioned in substantially a middle of a thickness of the concrete structure to be formed. The supports may be installed prior to or after positioning of the anchors and tension cables. Concrete is then poured into the formwork, illustrated as block 1112. When the concrete is cured, the tension cable(s) are tensioned from the end of the tension cable that extends through the apertures and fastened to the anchor 800, 900, or 1000, illustrated as block 1114, thereby compressing or pulling the anchors to the edge of the concrete structure.

Figure 12:
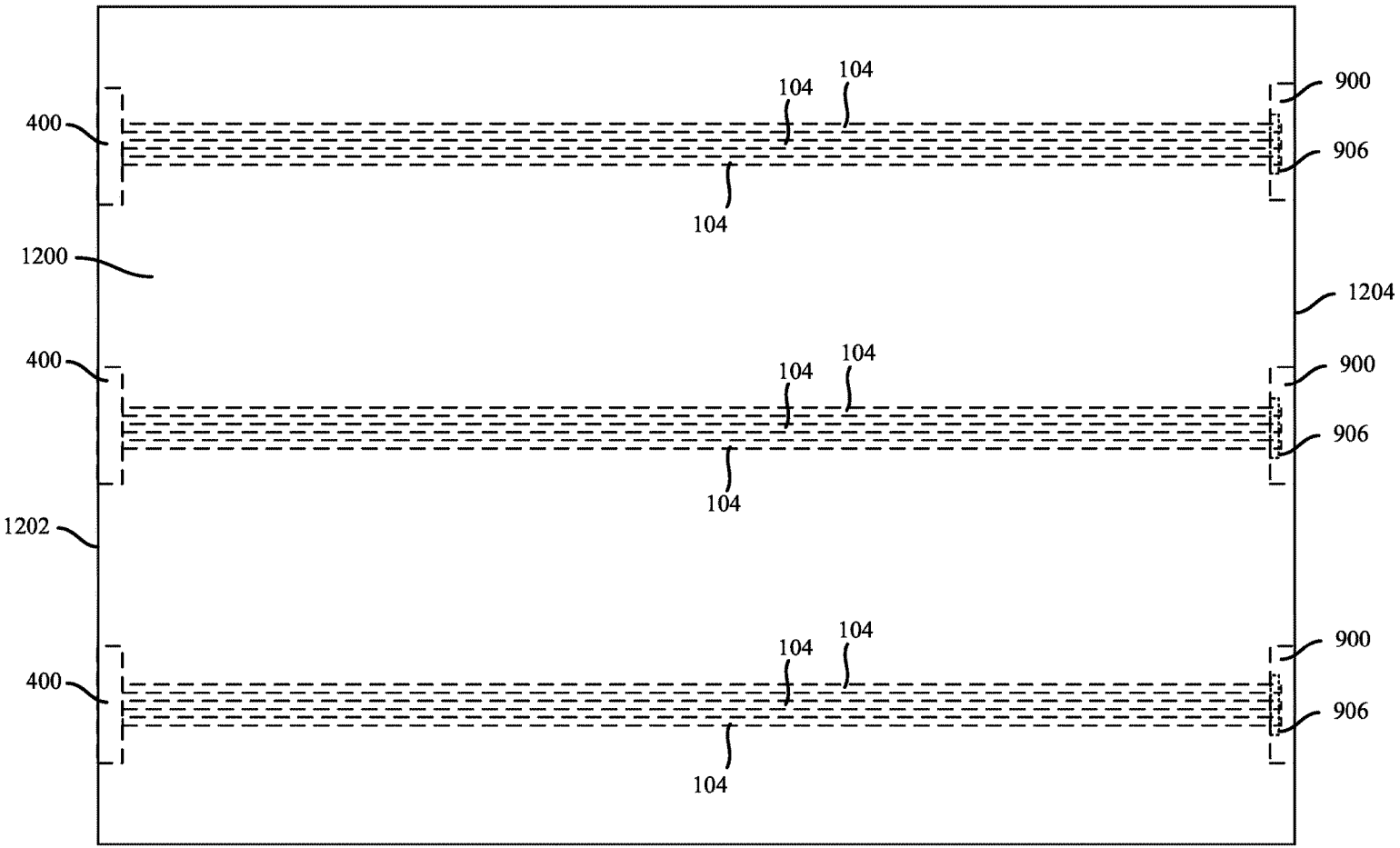
FIG. 12 is a top view of more than one anchor device installed according to an embodiment of the present invention.

Any one or more of the anchors 800, 900, or 1000 may also have a length or plurality of sections (similar that illustrated in FIGS. 9-10) allowing the anchor to extend across a desired portion of a vertical edge of a concrete structure. Further, a plurality of anchors may be used in construction of the concrete structure. For example, referring to FIG. 12, an example of the anchors 400 and 900 installed in a concrete structure 1200 is illustrated. The anchors 400 are located on a first vertical edge 1202 of the concrete structure 1200 and extends across a desired length of the first vertical edge 1202. Similarly, the anchors 900 are located on a second vertical edge 1204 of the concrete structure 1200 and extend across a desired length of the first vertical edge 1204. A plurality of tension cable groups, each including tension cables 104, extend from the anchors 400 across the concrete structure 1200. The tension cables 104 respectively extend through apertures 902 (not shown) in the corresponding anchors 900 and are coupled to the anchors 900 after being tensioned. As illustrated, the tension cables 104 are coupled to the anchors 900 via fastening devices 906. The fastening device 906 may be a cable anchor or nut, or cable bracket. The fastening device 906 may also include a head similar to that of the anchor pin 118, described above, that engages teeth 116. Similar fastening devices may also be used in the anchors 800 and 1000.

In the anchors described above, the channel 108 may be filled with a removable material. This removable material may reduce the risk of concrete leaking into the channel 108 when concrete is poured. The removable material may then be removed at one or more desired locations for the insertion of an anchor pin 118 for use in coupling a window or curtain wall to the anchor. The removable material may be, for example, foam or other type of material that is capable of resisting the leakage of concrete into the channel 108, while being easily removable form the channel 108 at one or more selected locations.

Figure 13:
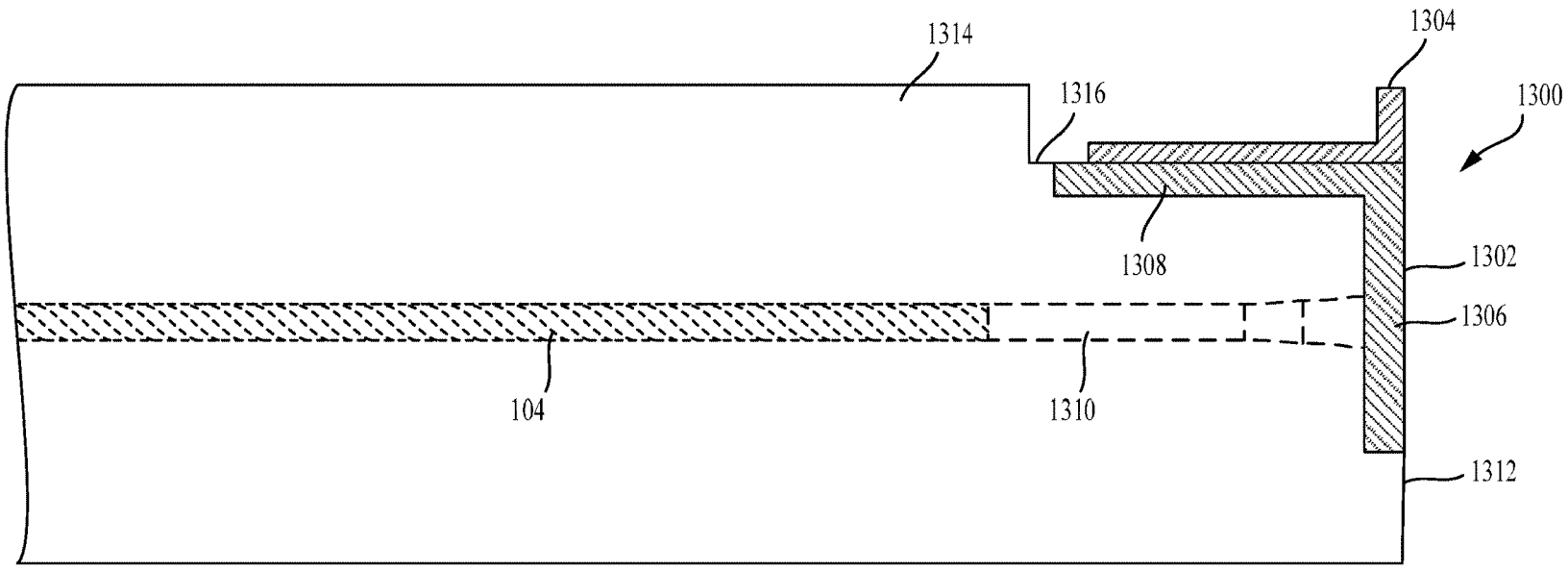
FIG. 13 is a side view of another anchor device according to an embodiment of the present invention.

In other embodiments, one or more anchors may provide a face of a plate and/or angle bracket for use in coupling a window wall or curtain wall to the anchor when the anchor is installed in a concrete structure, floor, wall, or other structure of the type. For example, referring to FIG. 13, an anchor 1300 may include a base portion 1302, one or more tension cables 104 coupled to the base portion 1302, and an angle bracket 1304 coupled to the base portion 1302. In this embodiment, the base portion 1302 forms an 'L' shape having a first portion 1306 and a second portion 1308 extending from the first portion 1306 in a substantially perpendicular direction.

The first portion 1306 includes an inner face or first side adapted to face toward a vertical edge of a concrete structure, and an outer face or second side adapted to face away from the vertical edge. The tension cable(s) 104 may be coupled to the inner face or first side of the first portion 1306 and extend from the first portion 1306 in a substantially perpendicular direction similar to that of the second portion 1308. The tension cable(s) 104 may be coupled to the first portion 1306 via welding, bracket 1310, and/or fasteners.

The second portion 1308 includes an outer face or first side adapted to face away from a horizontal edge of the concrete structure, and an inner face or second side adapted to face toward the horizontal edge. The angle bracket 1304 may be coupled to the outer face or first side of the second portion 1308. The angle bracket 1304 may be coupled to the second portion 1308 via welding, bracket 1310, and/or fasteners.

The anchor 1300 may also include a corresponding anchor, similar to those described above, that includes an aperture that receives the tension cable(s) 104 and allows the tension cable(s) 104 to be tensioned. In this embodiment, the anchor 1300 (including a corresponding anchor) may be installed in accordance with the methods described above. For example, the anchor 1300 may be positioned in a concrete formwork at a predetermined location prior to concrete being poured. In this example, the anchor 1300 may be positioned at a vertical edge 1312 of the concrete structure 1314 that is to be poured with the first portion 1306 facing away from the vertical edge 1312 and the second portion 1308 facing away from a horizontal top edge 1316 of the concrete structure 1314. The second portion 1308 may also be positioned in a cut-out or pocket of the concrete structure 1314. The tension cable(s) 104 extend into the concrete structure 1314. When the concrete is poured and substantially cured, the tension cable(s) 104 may be tensioned, thereby compressing or pulling the anchor 1300 inwardly to the edge of the concrete structure. The second portion 1308 and bracket 1304 allow for top horizontal access to the bracket 1304. This allows for a window wall or curtain wall to be coupled to and anchored to the bracket 1304 when the anchor 100 is installed in a concrete structure, floor, wall, or other structure of the type.

Figure 14:
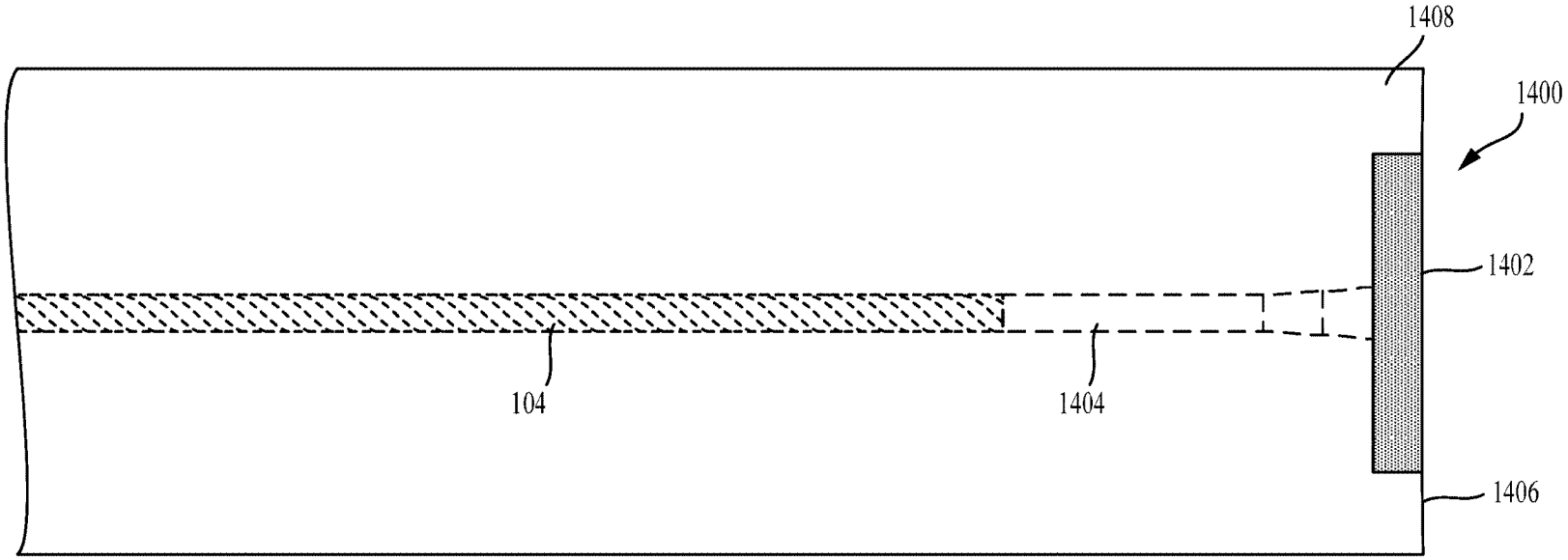
FIG. 14 is a side view of another anchor device according to an embodiment of the present invention.

In other embodiments, referring to FIG. 14, an anchor 1400 may include a base portion 1402 and one or more tension cables 104 coupled to the base portion 1402. The base portion 1402 includes an inner face or first side adapted to face towards a vertical edge of a concrete structure, and an outer face or second side adapted to face away from the vertical edge. The tension cable(s) 104 may extend from the inner face or first side of the base portion 1402 in a substantially perpendicular direction. The tension cable(s) 104 may be coupled to the base portion 1402 via welding, bracket 1404, and/or fasteners. The anchor 1400 may also include a corresponding anchor, similar to those described above, that includes an aperture that receives the tension cable(s) 104 and allows the tension cable(s) 104 to be tensioned.

In this embodiment, the anchor 1400 (including a corresponding anchor) may be installed in accordance with the methods described above. For example, the anchor 1400 may be positioned in a concrete formwork at a predetermined location prior to concrete being poured. In this example, the anchor 1400 may be positioned at a vertical edge 1406 of the concrete structure 1408 that is to be poured with the base portion 1402 facing away from the vertical edge 1406, and the tension cable(s) 104 extending into the concrete structure 1408. When the concrete is poured and substantially cured, the tension cable(s) 104 may be tensioned, thereby compressing or pulling the anchor 1400 inwardly to the edge of the concrete structure. An exposed side or face of the base portion 1402 allows for a window wall or curtain wall to be coupled to and anchored to the base portion 1402.

The anchors described herein may be used in combination with one another to allow for versatility in placement and anchoring of window or curtain walls. Any of the anchors described herein may also include one or more anchor studs and/or a one or more tension cables.

The present invention describes certain methods occurring in a particular order. However, this order is exemplary, and the processes of the present invention need not be performed in the stated order. In addition, any one or more steps of the disclosed processes can be interchanged or omitted without departing from the spirit and scope of the present invention.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. An anchor system for concrete, comprising:

a first anchor device adapted to be disposed along a first edge of a concrete structure and couple a first wall to the concrete structure, the first anchor device includes:

a first base portion having a first side and second and third sides extending from the first side in a first direction to cooperatively form a first 'C' shaped channel, wherein the first, second and third sides are adapted to be embedded in the first edge with an exterior of the first side facing in a direction towards the concrete structure; and a tension cable coupled to the first side of the first base portion and adapted to extend from the first side into the concrete structure;

a second anchor device adapted to be embedded in a second edge of the concrete structure opposite the first edge and aligned with the first anchor device, the second anchor device includes:

a second base portion having a first side and second and third sides extending from the first side of the second base portion in a second direction, and teeth respectively extending from edges of the second and third sides of the second base portion opposite the first side of the second base portion to cooperatively form a second 'C' shaped channel, wherein the first, second and third sides of the second base portion are adapted to be embedded in the second edge with an exterior of the first side of the second base portion facing in a direction towards the concrete structure;

an aperture extending through the first side of the second base portion and adapted to receive the tension cable therethrough; and a cut-out in at least a portion of the teeth, the cut-out is opposite and aligned with the aperture, and the cut-out is adapted to allow access for a tension tool to tension the tension cable when the tension cable is inserted through the aperture.

2. The anchor system of claim 1, wherein:

the first base portion includes:

first teeth respectively extending from edges of the second and third sides of the first base portion opposite the first side of the first base portion to cooperatively form the first 'C' shaped channel.

3. The anchor system of claim 2, wherein:

the first base portion includes a first anchor pin adapted to be received in the first channel and couple the first wall to the first edge of the concrete structure; and the second base portion includes a second anchor pin adapted to be received in the second channel and couple a second wall to the second edge of the concrete structure.

4. The anchor system of claim 2, wherein:

the first teeth form a fourth side of the first base portion and are adapted to face away from the first edge of the concrete structure and couple the first wall to the first edge of the concrete structure; and the teeth respectively extending from edges of the second and third sides of the second base portion form a fourth side of the second base portion and are adapted to face away from the second edge of the concrete structure and couple a second wall to the second edge of the concrete structure.

5. The anchor device of claim 1, wherein the second and third sides of the first base portion are substantially perpendicular to the first side of the first base portion, and the second and third sides of the second base portion are substantially perpendicular to the first side of the second base portion.

6. A method of constructing a post-tensioned concrete structure, comprising:

disposing a first anchor device at a first edge of a concrete formwork for the concrete structure, the first anchor device includes a first base portion adapted to couple a first wall to the concrete structure, wherein the first base portion includes a first side and second and third sides extending from the first side in a first direction to cooperatively form a first 'C' shaped channel, wherein the first, second and third sides are adapted to be embedded in the first edge with an exterior of the first side facing in a direction towards the concrete structure, and the first anchor device includes a tension cable coupled to the first side and that extends into the concrete formwork;

disposing a second anchor device at a second edge of the concrete formwork opposite the first edge and aligned with the first anchor device, the second anchor device includes a second base portion adapted to couple a second wall to the concrete structure, wherein the second base portion includes a first side and second and third sides extending from the first side of the second base portion in a second direction, and teeth respectively extending from edges of the second and third sides of the second base portion opposite the first side of the second base portion to cooperatively form a second 'C' shaped channel, wherein the first, second and third sides of the second base portion are adapted to be embedded in the second edge with an exterior of the first side of the second base portion facing in a direction towards the concrete structure, and the second anchor device includes an aperture in the first side of the second base portion that is adapted to receive the tension cable, and a cut-out in at least a portion of the teeth, the cut-out is opposite and aligned with the aperture, and the cut-out is adapted to allow access for a tension tool to tension the tension cable when the tension cable is inserted through the aperture;

extending the tension cable across the concrete formwork and through the aperture of the second anchor device;

pouring concrete into the concrete formwork, thereby embedding the first and second anchor devices in the respective first and second edges of the concrete structure; and tensioning the tension cable from the second edge after the concrete has hardened.

7. The method of claim 6, further comprising installing supports adapted to support the tension cable across the concrete formwork.

8. The method of claim 6, wherein tensioning the tension cable further includes inserting a tensioning tool into the cut-out.

* * * * *